US006905093B2

(12) United States Patent
Dryer et al.

(10) Patent No.: US 6,905,093 B2
(45) Date of Patent: Jun. 14, 2005

(54) DEPLOYMENT MECHANISM FOR STOWABLE FINS

(75) Inventors: Richard Dryer, Oro Valley, AZ (US); Rudolph Adolph Eisentraut, Tucson, AZ (US); Martin Allen Kebschull, Tucson, AZ (US); John Christopher Parine, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/672,533

(22) Filed: Sep. 26, 2003

(65) Prior Publication Data

US 2004/0144888 A1 Jul. 29, 2004

Related U.S. Application Data

(63) Continuation-in-part of application No. 10/102,032, filed on Mar. 19, 2002, now Pat. No. 6,761,331.

(51) Int. Cl.[7] ..... F42B 13/32
(52) U.S. Cl. ..... 244/3.28; 244/3.29
(58) Field of Search ..... 244/3.28, 3.27, 244/3.29, 49

(56) References Cited

U.S. PATENT DOCUMENTS

| | | | | |
|---|---|---|---|---|
| 2,271,280 A | | 1/1942 | Weinert | |
| 3,684,214 A | | 8/1972 | Kloss | 244/3.27 |
| 4,644,845 A | * | 2/1987 | Garehime, Jr. | 89/41.05 |
| 4,659,036 A | | 4/1987 | Pinson | 244/3.22 |
| 4,664,339 A | | 5/1987 | Crossfield | 244/3.28 |
| 4,667,899 A | | 5/1987 | Wedertz | 244/3.28 |
| 4,869,442 A | | 9/1989 | Miller | 244/3.28 |
| 5,114,095 A | | 5/1992 | Schroppel et al. | 244/3.28 |
| 5,762,294 A | | 6/1998 | Jimmerson | 244/3.28 |
| 6,092,264 A | | 7/2000 | Banks | 16/321 |
| 6,186,442 B1 | | 2/2001 | Bittle | 244/3.29 |
| 6,224,013 B1 | | 5/2001 | Chisolm | 244/3.27 |
| 6,454,205 B2 | | 9/2002 | Niemeyer et al. | 244/3.26 |

FOREIGN PATENT DOCUMENTS

| | | | |
|---|---|---|---|
| DE | 2649643 | 6/1978 | 244/3.29 |
| DE | 30 10 027 A1 | 3/1980 | |

OTHER PUBLICATIONS

International Search Report dated Jul. 25, 2003 from PCT/US03/07931.

* cited by examiner

*Primary Examiner*—Tien Dinh
(74) *Attorney, Agent, or Firm*—Renner, Otto, Boisselle & Sklar, LLP

(57) ABSTRACT

A deployment mechanism (414) in combination with a missile (10), guided projectile (410) or other ordnance that automatically pivots and rotates a fin (412) from a stowed orientation to a deployed orientation. The deployment mechanism (414) includes a tubular cam (434) having a retention mechanism (455) that retains the fin (412) simply and reliably in the stowed orientation. The tubular cam also guides the fin (412) quickly to the deployed orientation.

20 Claims, 11 Drawing Sheets

DEPLOYMENT MECHANISM FOR STOWABLE FINS

This application is a continuation-in-part of U.S. patent application Ser. No. 10/102,032, now U.S. Pat. No. 6,761,331, by Rudolph A. Eisentraught, Martin A. Kebschull and John C. Parine, entitled MISSILE HAVING DEPLOYMENT MECHANISM FOR STOWABLE FINS, filed on Mar. 19, 2002.

RIGHTS OF THE GOVERNMENT

The invention described herein was developed with Government support under Contract No. DAAH01-00-C-0107 awarded by the U.S. Department of the Army. The Government has certain rights in this invention.

FIELD OF THE INVENTION

The present invention generally relates to ordnance having stowable fins, and, more particularly, to a deployment mechanism for stowing and deploying the fins.

BACKGROUND OF THE INVENTION

Many types of ordnance utilize two or more protruding surfaces to affect the fluid flow around the ordnance, thereby facilitating control of its trajectory toward a target. Exemplary types of such ordnance include missiles, rockets, guided projectiles, bombs, torpedoes and the like.

For example, missiles generally have an approximately cylindrical body, with at least two aerodynamic surfaces or fins that extend outwardly from the sides of the missile body to affect the aerodynamic characteristics of the missile in flight. The fins typically have an airfoil shape that is oriented edge-on or slightly inclined relative to the airflow when the missile is flying in a straight line. These fins may be, for example, static (fixed) or dynamic (selectively movable, i.e., controllable). Fixed fins generally are used to stabilize the missile during flight and do not move once fully deployed. Controllable fins (control fins) are used to control or steer the missile by selectively varying the attitude of the fins relative to the airflow under the direction of the missile's control system.

In many cases, the fins are stowed in a position adjacent the outside surface of or within the missile body during storage and mounting on a vehicle prior to use. In some cases, the missile is stored in a tube, canister or other protective casing, and the protective casing also may serve as a launch tube. The fins are stowed to reduce the effective diameter of the missile, permitting more missiles to be stored and/or transported in a limited space. It also reduces the likelihood of damage to the fins during storage and handling. Additionally, it allows for the maximum use of the internal space of the missile for electronic components and warheads.

The fins are extended from the stowed position shortly after deployment of the missile, either during mounting or launch of the missile. Various relatively complex deployment mechanisms have been developed to permit the fins to be stowed, deployed and locked into place. Control fins may further be moved (usually only rotated) by an actuator system once the control fins are deployed.

With regard to guided projectiles, in some cases, the fins are stowed by folding the fins like jack knifes or sling blades into the body of the projectile through longitudinal slots in the projectile's housing. Complicated retention features and housings are provided to retain the fins in the body of the projectile until the projectile has cleared the bore of the weapon system, e.g., a cannon, a gun, a howitzer, a mortar tube, or the like. For example, covers are employed to seal the longitudinal slots and retain the fins until needed in flight. In some cases, multiple mechanisms are used, for example, a cover deployment mechanism is provided to effectively discard the covers and a deployment mechanisms is provided to deploy the fins in flight.

The mechanisms presently used to retain, deploy and control (if applicable) the fins tend to be relatively heavy, complex and expensive to design, build and maintain. Moreover, some mechanisms occupy a relatively large volume within the missile, a significant disadvantage because of the limited space within the missile.

SUMMARY OF THE INVENTION

There is a need for a simple and reliable device to retain or lock stowable ordnance fins in a stowed configuration, support, deploy, lock stowable ordnance fins into a deployed configuration and, in some cases, control the fins in the deployed configuration. The present invention provides a deployment mechanism for stowing and deploying stowable fins that meets this need and provides further advantages in cost, weight and space savings.

More particularly, the present invention provides a missile with the deployment mechanism that automatically deploys a fin from a stowed orientation to a deployed orientation as soon as the fin is released. The deployment mechanism includes a spring that provides a biasing force that urges the fin to move quickly, simply and reliably from the stowed orientation to the deployed orientation. The deployment mechanism also includes one or more cam slots or other means for guiding the fin from the stowed orientation to the deployed orientation.

An exemplary deployment mechanism for the missile includes a tubular cam body that can be mounted in a cylindrical cavity in the missile body. A drive pin is connected to the cam body through the spring which biases the drive pin to the deployed orientation. The fin is connected to a cam pin that extends into cam slots in the cam body to guide the fin as it is deployed. The cam pin also interconnects the fin and the drive pin. The drive pin and the spring thus cooperate to move the fin from the stowed orientation to the deployed orientation, while the cam pin and the cam slots guide the fin as it is deployed. The cam slots may also rotate the fin as it is deployed and/or lock the fin in place. Such a deployment mechanism can be used with either a fixed fin or a dynamic control fin, in any type of ordnance having stowable fins, including the missile described herein. To simplify the description, reference herein is specifically directed to missiles, but such reference includes other types of ordnance where the description would be applicable.

More particularly, one aspect of the invention relates to a deployment mechanism for a missile having at least one aerodynamic fin. The deployment mechanism comprises a spring mountable in a missile for deploying the at least one fin. The deployment mechanism is operable to move the at least one fin from a stowed orientation to a deployed orientation that is different from the stowed orientation.

Another aspect of the invention relates to the deployment mechanism further including a tubular cam having at least one cam slot and a cam pin connected to the at least one fin. The spring is connected to the cam pin to urge the cam pin to a deployed configuration. The deployed configuration includes the at least one fin in the deployed orientation. The cam pin is movable along and guided by the at least one cam slot to pivot the at least one fin and to rotate the at least one fin from the stowed orientation to the deployed orientation.

Yet another aspect of the invention relates to the deployment mechanism having at least one aerodynamic fin, comprising a tubular cam including a retention mechanism mountable in a projectile for deploying the at least one fin from a stowed orientation to a deployed orientation that is different from the stowed orientation.

Still another aspect of the invention relates to a guided projectile comprising at least one aerodynamic fin; and a deployment mechanism including a tubular cam including a retention mechanism for deploying the at least one fin from a stowed orientation to a deployed orientation that is different from the stowed orientation.

To the accomplishment of the foregoing and related ends, the invention provides the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

Figure 1:
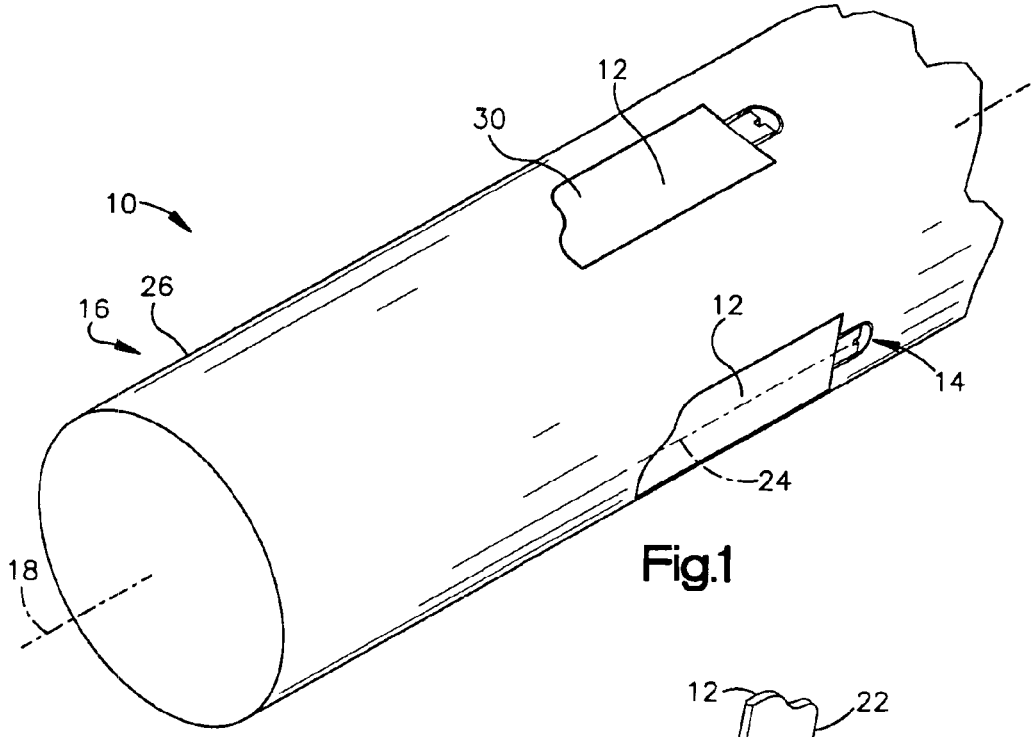
FIG. 1 is a partial and schematic perspective view of a forward section of an exemplary missile body with aerodynamic fins in a stowed configuration.

In the detailed description that follows, similar components in different embodiments will have a similar reference numeral incremented by 100. For example, in a first embodiment, a cam is assigned reference number 34. Subsequent embodiments may use reference numbers 134, 234, 334, etc., for the cam bodies of subsequent embodiment, although the cam body may have a different configuration in the different embodiments. For the sake of brevity, in-depth descriptions of similar components may be omitted from descriptions of subsequent embodiments.

DETAILED DESCRIPTION

Figure 2:
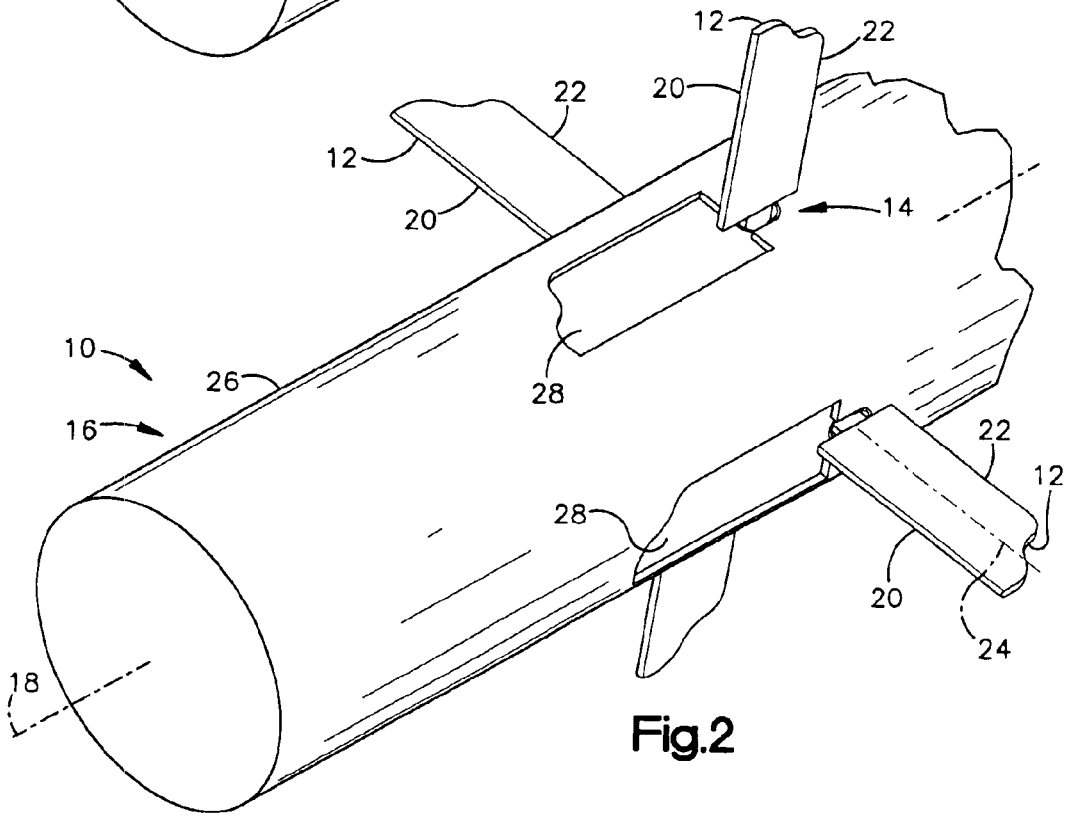
FIG. 2 is a partial and schematic perspective view of the missile shown in FIG. 1 with the fins in a deployed configuration.

Referring now to the drawings, and initially to FIGS. 1 and 2, the present invention provides ordnance, such as a missile 10, having a plurality of fins 12 for stabilizing or controlling the missile during flight. The missile 10 includes at least one stowable fin 12 and a deployment mechanism 14 for moving the fin 12 from a stowed configuration (FIG. 1) to a deployed configuration (FIG. 2) so that the missile 10 can be stored or launched in a more compact configuration. The illustrated missile 10 has four fins 12 mounted to a generally cylindrical body (missile body) 16 having a longitudinal axis 18. Although the present description refers to the missile 10 shown in the drawings, the illustrated missile 10 represents any type of ordnance that uses stowable fins and is not limited to a missile.

Each fin 12 has a leading edge 20 and a trailing edge 22 that bound the width of the fin 12, and a longitudinal axis 24 that extends approximately along the length of the fin 12. The leading edge 20 of the fin 12 preferably faces in a forward direction generally toward the leading or forward end of the missile 10 during flight. The thickness of the fin 12 is less than its width or length, and the geometry of the fin 12 is selected for its intended application.

In the stowed configuration shown in FIG. 1, the fins 12 lie adjacent to a surface 26 of the missile body 16. The longitudinal axis 24 of each fin 12 approximately parallels the longitudinal axis 18 of the missile body 16, and the leading edge 20 and the trailing edge 22 of each fin 12 face sideways to provide a compact stowed configuration wherein the missile 10 occupies a minimum volume. In the illustrated embodiment, the missile body 16 has a longitudinally extending recess 28 (FIG. 2) in its surface 26 for receiving the fin 12 in the stowed or stored configuration. With the fin 12 stowed and received in the recess 28, an outer surface 30 (FIG. 1) of the fin 12 generally conforms to the outer surface 26 of the missile 10. The recess 28 has a shape and size sufficient to receive the fin 12 while minimizing the volume of the missile 10 taken up by the recess 28. In the illustrated embodiment, the recess 28 extends from an end of the fin 12 that is attached to the missile 10 toward the forward end of the missile 10.

In the deployed configuration shown in FIG. 2, each fin 12 extends from the surface of the missile body 16. The longitudinal axis 24 of the fin 12 is approximately perpendicular to the longitudinal axis 18 of the missile body 16, and the leading edge 20 generally faces toward the forward end of the missile 10. The fin 12 is connected to the missile body 16 through the deployment mechanism 14, which moves the fin 12 from the stowed orientation to the deployed orientation.

Figure 3:
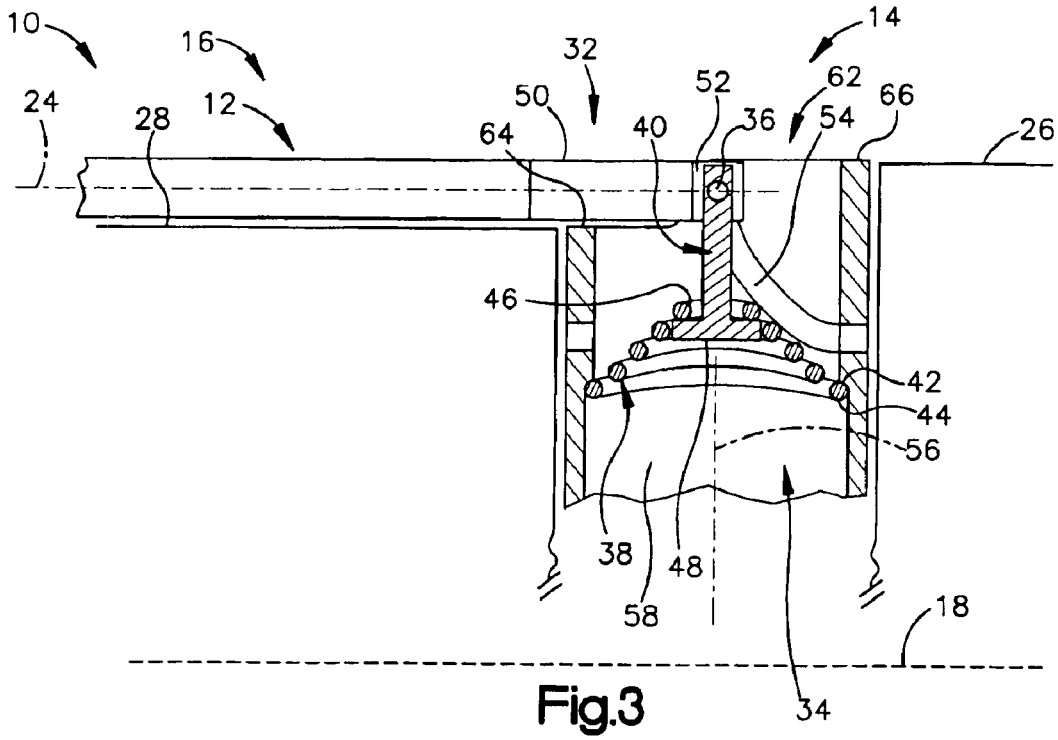
FIG. 3 is a schematic cross-sectional view of a section of the missile body showing the fin and a sectioned deployment mechanism in accordance with the invention in the stowed configuration.
Figure 4:
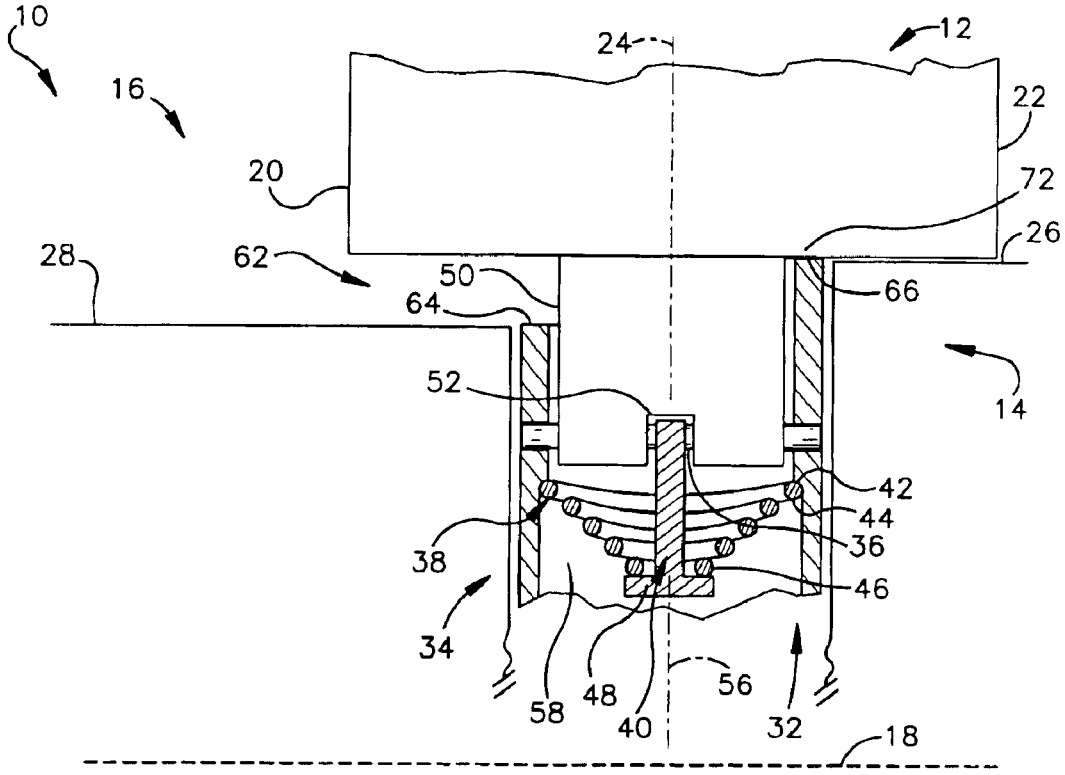
FIG. 4 is a schematic cross-sectional view of a section of the missile body showing the fin and the sectioned deployment mechanism in the deployed configuration.
Figure 5:
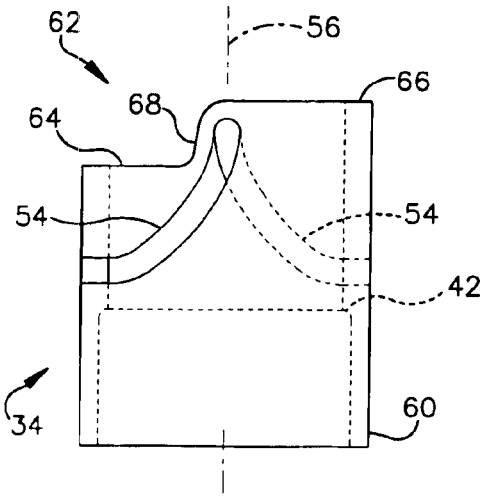
FIG. 5 is an elevational view of a tubular cam in accordance with the invention.

Referring now to FIGS. 3–5, an assembly, including the fin 12 and the deployment mechanism 14, is mounted at least partially in a cavity 32 in the missile body 16 (FIGS. 3–4). The deployment mechanism 14 includes a tubular cam 34, a cam pin 36, a drive spring 38, and a drive pin 40. The cam 34 has an internal step, shelf or ledge 42 formed by an abrupt change in its internal diameter for engaging an outer coil 44 of the drive spring 38, which in the illustrated embodiment is a conical spring. An inner coil 46 of the drive spring 38 is connected to the drive pin 40 for applying force thereto. In the illustrated embodiment, the inner coil 46 of the drive spring 38 engages a flange portion 48 of the drive pin 40 that has a greater lateral extent than an adjacent portion of the drive pin 40. In other words, the flange portion 48 is an annular ring or disk at one end of a smaller diameter (generally cylindrical) portion of the drive pin 40. The drive spring 38 is mounted inside the cam 34, interposed between the shelf 42 and the flange portion 48 of the drive pin 40 to urge or bias the drive pin 40 to the deployed orientation.

The drive pin 40 interconnects the drive spring 38 and the cam pin 36. In the illustrated embodiment, a connecting portion 50 of the fin 12 has a central notch 52 at a free end thereof and the cam pin 36 is mounted to traverse the central notch 52. The end portions of the cam pin 36 extend beyond the edges of the connecting portion 50 to engage cam slots 54. The drive pin 40 is connected to the cam pin 36 within the central notch 52. The cam pin 36 is rotatable with respect to at least one of the drive pin 40 and the connecting portion 50 of the fin 12 to allow the fin 12 to pivot about a longitudinal axis of the cam pin 36. The cam pin 36 also rotates about a central axis approximately coextensive with a longitudinal axis 56 of the cam 34. The cam pin 36 generally remains perpendicular to the longitudinal axis 56 of the cam 34 as it rotates.

The cam pin 36 is guided by at least one cam slot or groove 54 extending from an inner surface 58 of the cam 34 that receives and guides end portions of the cam pin 36. In other words, the cam pin 36 acts as a follower as it traces the cam slots 54. The cam slots 54 may extend partially or completely through the wall of the cam 34. In the illustrated embodiment, the cam 34 has a pair of diametrically opposed and approximately helical slots 54 that guide the cam pin 36 to simultaneously rotate and translate along the longitudinal axis 56 of the cam 34 (FIG. 5). The shape of the cam slots 54 may be tailored to vary the path and orientation of the fin 12 as the cam pin 36 moves between the stored and deployed configurations.

The cam 34 guides the deployment of the fin 12 and generally is fixed in the cavity 32 against rotation in at least one direction, for example, by mating a threaded end (mounting end 60, FIG. 5) of the cam 34 with corresponding threads in the cavity 32 (not shown). This helps to keep the cam 34 from coming loose as the fin 12 rotates into position. An opposite end of the cylindrical cam 34 (a working end 62), includes a pair of stepped faces 64 and 66 (hereinafter pivot face 64 and stop face 66) separated by two laterally spaced upright faces (one shown, FIG. 5) 68, extending generally parallel to the longitudinal axis 56 of the cam 34. The upright faces 68 are interposed between the pivot face 64 at the lower step and the stop face 66 at an upper step. The pivot face 64 is formed by the absence of a semi-cylindrical section at the working end 62 of the cam 34. The cam 34 is mounted to the missile 10 such that the pivot face 64 is even with or proud of the surface of the recess 28 adjacent the cavity 32. The stop face 66 generally extends above the missile surface 26. As the fin 12 is moved from the stowed orientation to the deployed orientation, the fin 12 simultaneously pivots about the pivot face 64 and rotates about the longitudinal axis 56 of the cam 34, with an end 72 of the fin 12 engaging the stop face 66 in the deployed orientation. The laterally extending end portions of the cam pin 36 travel through the cam slots 54 until the cam pin 36 reaches the deployed configuration (FIG. 2) with the lateral end portions at or near the respective ends of the cam slots 54. The end portions of the cam slots 54 may provide positive stops for the cam pin 36 corresponding to the stored and deployed orientations of the fin 12. In other words, the cam pin 36 may engage the ends of the cam slots 54 at the stored and deployed orientations of the fin 12, respectively.

In operation, the cam slots 54 effect simultaneous rotational and pivotal movement of the fin 12 in response to the telescoping axial movement of the drive pin 40. Retraction of the drive pin 40 by the drive spring 38 urges the cam pin 36 (in the illustrated orientation) through the cam slots 54 simultaneously rotating the cam pin 36 and the fin 12 through approximately ninety degrees (90°) from the stowed orientation (FIG. 3) to the deployed orientation (FIG. 4). At the same time, the connecting portion 50 of the fin 12 pivots about the pivot face 64 of the cam 34 and moves into the cam 34. The pivot face 64 effectively functions as a fulcrum for moving the longitudinal axis 24 of the fin 12 as the fin 12 moves from an orientation substantially parallel to the longitudinal axis 18 of the missile body 16 (FIG. 3) to an orientation substantially perpendicular to the longitudinal axis 18 of the missile body 16 (FIG. 4). Stated another way, the cam pin 36 and the cam slots 54 translate the axial movement of the drive pin 40 into both a rotational and axial movement of the fin 12 as the cam pin 36 follows the cam slots 54.

With the fin in the stowed orientation (FIG. 3), the drive spring 38 stores potential energy. When released, the deployment mechanism 14 simultaneously pivots and rotates the fin 12 from the stowed orientation (FIG. 3) to the deployed orientation (FIG. 4). The energy of the drive spring 38 drives the cam pin 36 along the longitudinal axis 56 of the cam 34 and also holds the fin 12 in the deployed orientation once deployed. Resistance created by airflow over the missile 10 also may help to deploy and to retain the fin 12 in the deployed orientation. The assembly can, of course, be modified to accommodate different sizes, configurations and types of ordnance. For example, the drive springs 38 are selected to provide the appropriate power for the size of the fins 12.

A locking mechanism (not shown) may further be provided to retain the fin 12 in the deployed orientation. For example, the end portions of the cam pin 36 may be spring-loaded and outwardly biased into blind rather than through slots, and a locking detent (not shown) may be provided at an end of the cam slots 54. The spring-loaded portions would travel along the cam slots 54 until reaching respective detents, where the end portions would extend further into the detents to lock the cam pin 36 in place. Alternatively, a bump (not shown) may be formed in the cam slots 54 over which the spring-loaded end portions would readily pass over in a first direction, but which would inhibit or prevent the spring-loaded end portions from passing in a second direction opposite the first direction.

A retaining mechanism (not shown) also may be used to prevent the fins 12 from moving prematurely from the stowed orientation. For example, a tab on the fin 12 may be held in place by a flange extending from the outer surface 26 of the missile body 16 to help hold the fin 12 in the stowed orientation until deployed. Locking pins (not shown) also may be used.

Turning to FIGS. 6–10, another assembly of a fin 112 and an alternative deployment mechanism 114 is shown. To facilitate the description, similar elements have been given similar reference numbers incremented by a factor of one hundred (100). As in the prior embodiment, the deployment mechanism 114 includes a cam 134, a cam pin 136, a drive spring 138 and a pivot pin 140. The cam pin 136 spans a central notch 152 in a connecting portion 150 of the fin 112 and extends into a cam slot 154 in the wall of the cam 134. In this embodiment, the relative positions of the drive spring 38 (FIG. 3) and the drive pin 40 (FIG. 3) of the prior embodiment have been reversed. Consequently, the drive spring 138 is interposed between the cam pin 136 and the pivot pin 140 and does not directly act on the cam body 134.

The drive spring 138 is an extension spring having a loop or hook 174 at one end for engaging the cam pin 136 and a bent tab 176 at the opposite end. The pivot pin 140 in turn is held in a disk 178 at the mounting end of the cam 134. The disk 178 may be secured to the cam 134 by corresponding threads (not shown) on the disk 178 and at the mounting end of the cam 134. Alternatively, the disk 178 may be held against an internal shelf 142 of the cam 134 (FIG. 8) by the drive spring 138. The cam 134 includes the internal shelf 142 that forms a stop that limits how far the disk 178 can extend into the cam 134. The drive spring 138 holds the pivot pin 140 in the disk 178. However, the pivot pin 140 is rotatable relative to the disk 178 about a longitudinal axis generally parallel to a longitudinal axis 156 of the cam 134 as the drive spring 138 rotates with the cam pin 136. This arrangement further reduces the number of moving parts. Further, this arrangement provides additional force on the cam pin 136 which increases the reliability of the deployment mechanism 114. Further still, this arrangement reduces the number of assembly steps, for example, by allowing the tab 176 of the drive spring 138 to be inserted into the pivot pin 140 from the outside of the cam 134.

Turning to a detailed description of individual components, the disk 178 has a large diameter ring portion 180 and a small diameter disk portion 182 adjacent the ring portion 180. The disk portion 182 fits inside the cam 134 and engages the internal shelf 142 when the disk 178 is fully tightened or inserted. The disk portion 182 also includes a hole or slot or other opening 184 for receiving the pivot pin 140 extending therethrough as will be explained below. The disk portion 182 is connected to an inner diameter of the ring portion 180 thereby forming a cavity inside the ring portion 180 for receiving the pivot pin 140.

The pivot pin 140 is similar to the drive pin 40 shown in FIG. 3. The pivot pin 140 has a generally cylindrical body 186 having a through hole 188 extending transverse to the longitudinal axis of the body for receipt of the tab portion 176 of the drive spring 138. A flange portion 148 having a greater lateral extent is connected to an adjacent portion of the cylindrical body 186. In the illustrated embodiment, the flange portion 148 is an annular ring or disk having a diameter that is larger than the opening 184 in the disk portion 182 of the disk 178. When the pivot pin 140 is inserted through the opening in the disk 178, the flange portion 148 is received in the cavity. When assembled, the pivot pin 140 is free to rotate about a longitudinal axis corresponding to the longitudinal axis 156 of the cam 134. During the deployment motion, the pivot pin 140 rotates with the drive spring 138 as the drive spring 138 rotates with the cam pin 136.

The drive spring 138 generally extends along a longitudinal axis perpendicular to the cam pin 136 and is telescopically received in the tubular cam 134 for extension and retraction generally parallel to the longitudinal axis 156 of the cam 134. The drive spring 138 is an extension spring formed of several coils. On one end, the last coil forms the hook 174. On the other end, the last coil is formed into the tab 176.

The pivot pin 140 and the disk 178 anchor the drive spring 138 to the cam 134. The drive spring 138 interconnects the pivot pin 140 and the cam pin 136 to pull the cam pin 136 through the cam slots 154 and toward the pivot pin 140. The cam pin 136 interconnects the drive spring 138 and the fin 112. In the illustrated embodiment, the cam pin 136 has an annular groove 190 for receiving the hook portion 174 of the drive spring 138 within the central notch 152 of the fin 112. The annular groove 190 inhibits lateral motion of the hook 174 relative to the cam pin 136.

In the illustrated embodiment, respective ends of the cam slot 154 extend in a direction substantially parallel to the longitudinal axis 156 of the cam 134 to prevent rotation of the fin 112 when the cam pin 136 is moving through that portion of the cam slot 154. Accordingly, the cam slot 154 forces the fin 112 to pivot from the stowed orientation without rotating right away, unlike the previous embodiment.

At an upper or working end 162 of the cam 134, the cam 134 has a central notch or axially relieved portion 164 formed between two laterally spaced wall sections 168 and 170. A wedge block 192 (FIG. 6) is formed on the axially relieved portion 164 of the cam 134 between the wall sections 168 and 170. The wedge 192 is located approximately in the center of the axially relieved portion 164 and provides a fulcrum or pivot point upon which the fin 112 initially pivots as it deploys. The wedge 192 also may be used as a stop to further prevent or minimize the fin 112 from rocking when it is in the deployed orientation. A rocking motion of the fin 112 may occur in a direction toward and away from the forward end of the missile. The wedge 192 has a narrow stop on top that engages the fin 112 during deployment. The wedge 192 has a wide base to distribute the stresses acting upon it.

From the axially relieved portion 164, the wall section 170 includes a ramp 194 that spirals downward, toward the opposite end of the cam 134, in a clockwise direction. The ramp 194 has a slope that helps to control the fin 112 as it is deployed. As the fin 112 is deployed, the end or base 172 of the fin 112 engages the ramp 194 and spirals down the slope until the fin 112 engages a stop 196 (FIG. 9) formed by an end of the opposing wall section 168. The wall section 168 generally has a uniform height that extends above the lower end of the ramp 194 and prevents further rotation of the fin 112. When the fin 112 engages the stop 196, the stop 196 prevents further rotation of the fin 112, but allows the fin 112 to move parallel to the longitudinal axis 156 of the cam 134 as will be further explained below.

In the illustrated embodiment, the fin 112 has a tapered tab 198 formed therein at the base of the fin 112 to help lock the fin 112 in the deployed orientation. The cam 134 further includes a slot 200 between the end of the ramp 194 and the stop 196. The slot 200 forms part of a fin locking mechanism 202.

Figure 9:
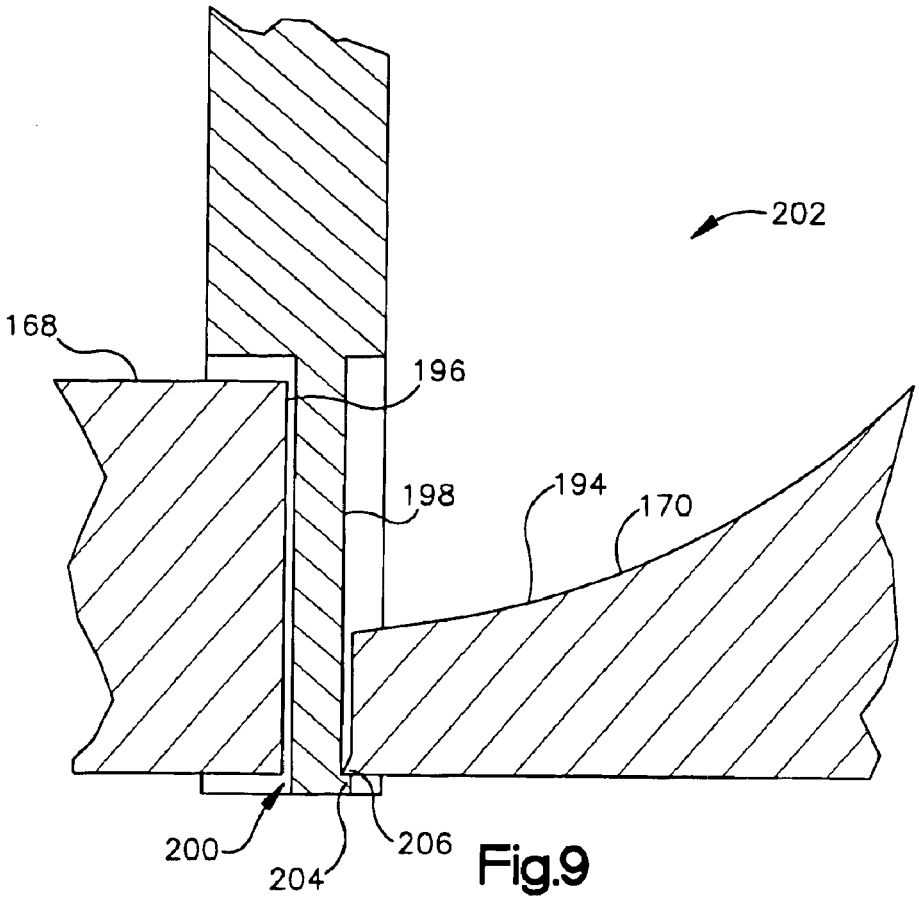
FIG. 9 is a partial and schematic cross-sectional view of a fin locking mechanism provided by the present invention.

Referring additionally to FIG. 9, the tapered tab 198 may have a raised rim 204 on a lower end thereof, the tapered tab 198 engages the fin locking mechanism 202 when the fin 112 is in the deployed configuration. The tapered tab 198 is shaped to slide into the slot 200 in a first direction, downward in the illustrated orientation, but would be inhibited or prevented from passing in a second direction opposite the first direction by the raised rim 204. The raised rim 204 engages a corresponding raised stop 206 portion of the fin locking mechanism 202 and thus prevents the fin 112 from moving from the deployed orientation.

To assemble the deployment mechanism 114, the drive spring 138 is inserted into the cam 134. The tab 176 of the drive spring 138 is inserted through the hole 184 and into the through hole 188 of the pivot pin 140. The pivot pin 140 is inserted into the disk 178. The connecting portion 150 of the fin 112 is inserted into the cam 134, the hook 174 of the drive spring 138 is placed within the notch 152 and the cam pin 136 is inserted through the connecting portion 150 and within the hook 174 of the drive spring 138 through the slots 154. Thus, the hook 174 of the drive spring 138 is placed in the annular groove 190 of the cam pin 136 and within the notch 152 of the connecting portion 150 of the fin 112. The disk 178 is secured in the cam 134 by the spring 138.

Sequential images illustrating the deployment of the fin 112 from the stowed orientation to the deployed orientation are shown in FIGS. 10*a*–10*e*. The fin 112 is shown in the stowed orientation in FIG. 10*a*. As soon as the fin 112 is released, the fin 112 pivots about the wedge 192 of the axially relieved portion 164 of the cam 134. The fin 112 then pivots approximately ninety degrees (90°) as the cam pin 136 moves within the cam slots 154 in an axial direction towards the disk 178. Next, the laterally extending end portions of the cam pin 136 spiral through the cam slots 154 (M2). The fin 112 simultaneously rotates with the cam pin 136 and moves downward into the cam 134 with the cam pin 136 (M2). The end 172 of the fin 112 engages and slides along the ramp 194 of the wall section 170 until the end 172 engages the stop 196 of the wall section 168 (M2). Next, the fin 112 moves in an axial direction towards the disk 178 (M3). The tapered tab 198 of the fin 112 engages the fin locking mechanism 202 as the end portions of the cam pin 136 follow the end portions 208 of the slots 154. The forward end of the fin 112 engages the stop of the wedge 192. Thus, the fin 112 is fully deployed with a leading edge 120 facing the forward end of the missile 10 (FIG. 2). The fin locking mechanism 202 cooperates with the end portions 208 of the cam slots 154 and the stop of the wedge 192 to reduce the rocking of the fin 112 relative to the cam 134 during the remainder of the missile's flight. Specifically, the wedge 192 prevents the fin 112 from coming out of the locking mechanism 202 during a forward rocking motion of the fin 112.

The deployment mechanism 114 shown in FIGS. 6–10 is continuously active as is the case with the deployment mechanism 14 shown in FIGS. 3 and 4. In other words, the deployment mechanism 114 continuously applies a force to the fins 112. This urges the fins 112 to rotate from the stowed orientation to the deployed orientation.

During the assembly of the missile, the fins 112 are assembled in or moved to the stowed orientation and placed inside a missile launch tube, for example (not shown). As a result of placing the fins 112 in the stowed orientation, the deployment mechanism 114 continuously applies a force to the pivot pin 140 along the longitudinal axis 156 of the cam 134 toward the disk 178. Without a locking mechanism to retain the fins 112 against the missile body 16 (FIG. 1), the fins 112 pivot about the axially relieved portion 164 with the distal end of the fins 112 moving away from the surface of the missile 26 (FIG. 1) and engaging an inner surface of the launch tube. The inner surface of the launch tube thus prevents the fins 112 from fully deploying.

During launch, the distal ends of the fins 112 engage the inner surface of the launch tube as the missile moves down the launch tube. Once the fins 112 clear the end of the launch tube, the deployment mechanisms 114 can complete the deployment of the fins 112. The drive springs 138 urge the laterally extending end portions of cam pins 136 to move through the cam slots 154. The fins 112 pivot and then rotate with the cam pins 136 until the bases of the fins 112 engage the fin locking mechanisms 202 and the stops of the wedges 192 of the cams 134. Thus, the fins 112 fully deploy with the leading edges 120 facing the forward end of the missile 10 (FIG. 1) and with a longitudinal axis 124 of each fin 112 extending substantially perpendicular to the surface of the missile 26 (FIG. 2).

In an alternative embodiment, the deployment mechanism 114 may be manually or automatically activated. A retaining mechanism (not shown), such as a retaining pin, may be used to hold each fin 112 in the stowed orientation. Once the retaining pin is removed, the deployment mechanism 114 deploys the fin 112 as described in the preceding paragraph.

Figure 6:
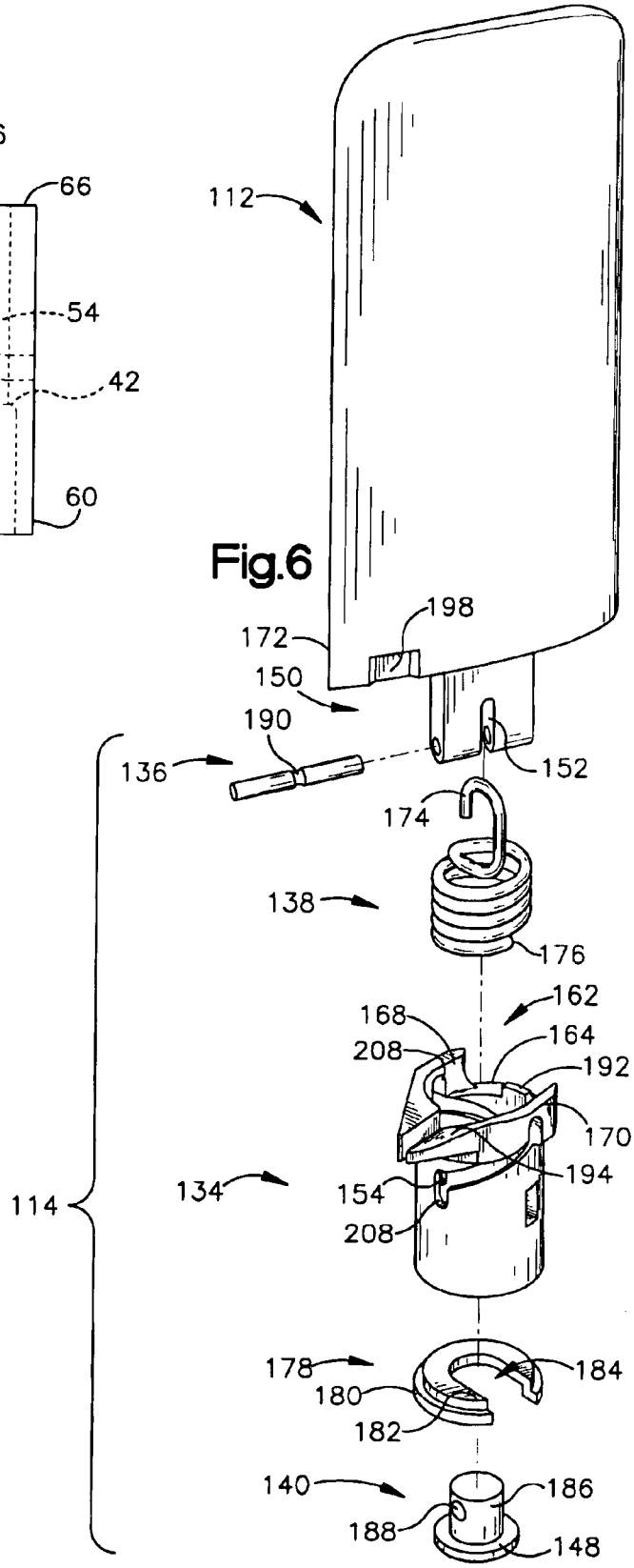
FIG. 6 is an exploded schematic perspective view of the fin and the deployment mechanism in accordance with another embodiment of the invention.
Figure 7:
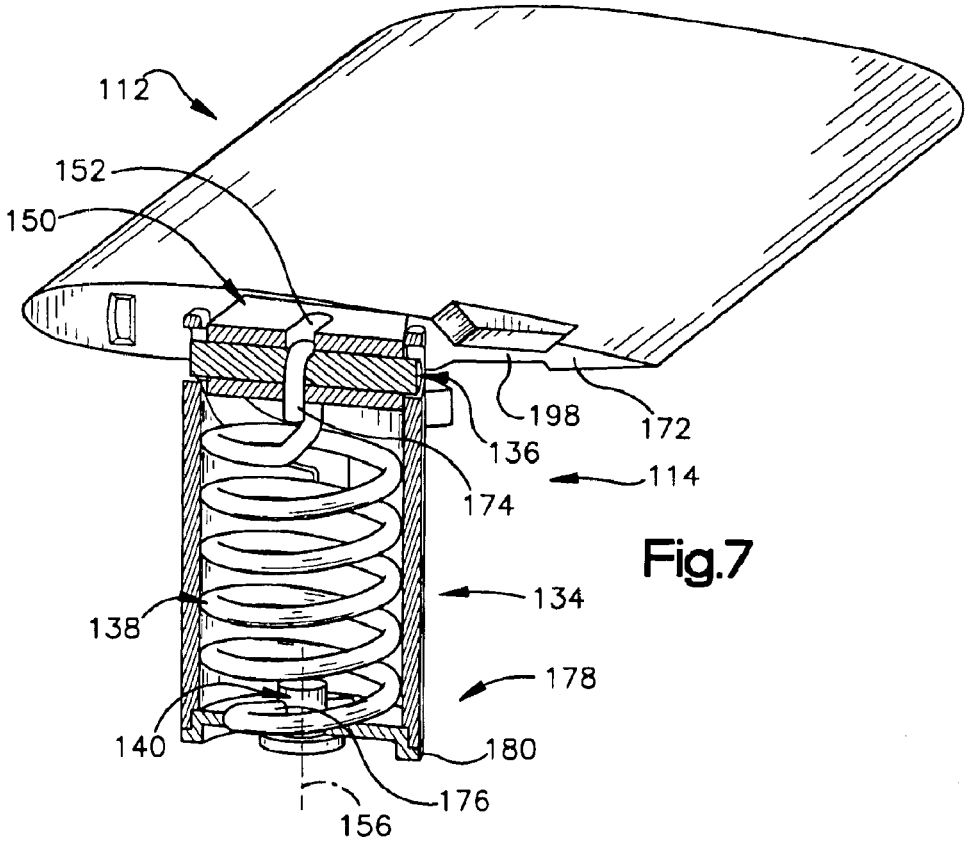
FIG. 7 is a partial and schematic perspective view of the fin and the deployment mechanism of the embodiment shown in FIG. 6 in the stowed configuration partially in section.
Figure 8:
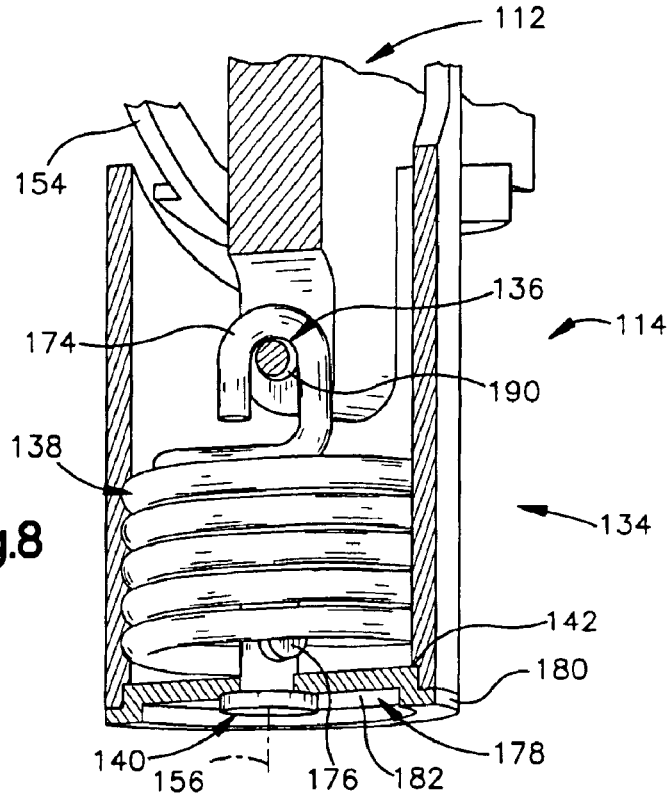
FIG. 8 is a partial and schematic perspective view of the fin and the deployment mechanism of the embodiment shown in FIG. 6 in the deployed configuration partially in section.
Figure 11A:
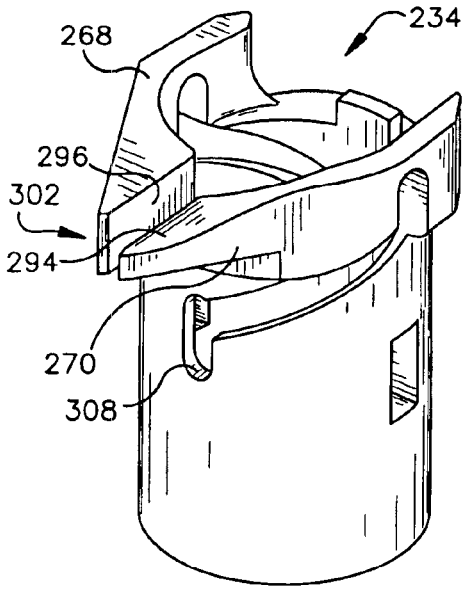
FIGS. 11*a*–11*b* are schematic perspective views of a tubular cam in accordance with yet another embodiment of the invention.
Figure 11B:
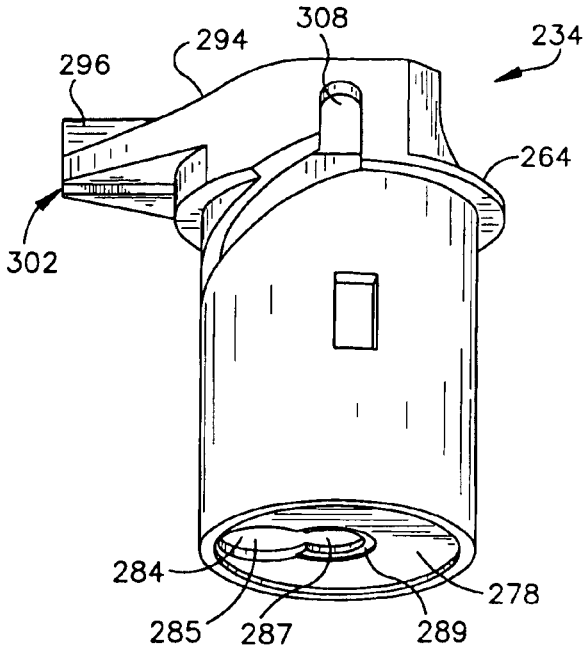
Figure 12:
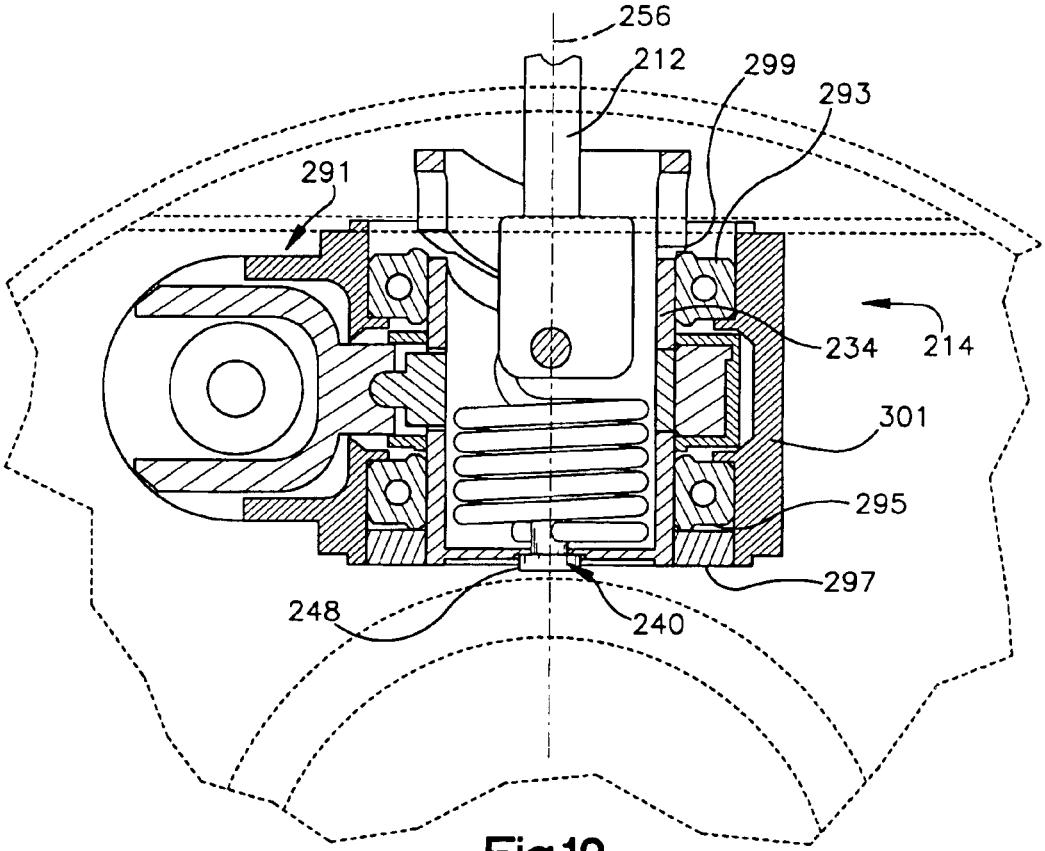
FIG. 12 is a partial and schematic cross-sectional view of the fin and the deployment mechanism shown in FIGS. 10*a*–10*b* in an actuator system of the missile.

FIGS. 11*a*–11*b* and 12 show another assembly of a fin 212 and another embodiment of a deployment mechanism 214. The deployment mechanism 214 is substantially the same as the previously described deployment mechanism 114 (FIG. 6). However, the deployment mechanism 214 includes an alternative cam 234. In this embodiment, the disk 178 (FIG. 6) in the previous embodiment is incorporated into the mounting end of the cam 234 to form a single unit. In other words, the cam 234 has a closed end 278 that performs the function of the disk 178 (FIG. 6). The closed end 278 is in the shape of a disk and has an opening 284 therethrough. The opening 284 may be shaped as two interconnecting openings with a large diameter opening 285 near an outer edge of the closed end 278 and a small diameter opening 287 near the center of the closed end 278. Surrounding the small diameter opening 287 is a recessed surface 289 for receiving the flange 248 of the pivot pin 240. The closed end 278 of the cam 234 allows the final assembly to be completed completely from the exterior. This embodiment further reduces the number of parts of the deployment mechanism 214.

The assembly, including the control fin 212 and the deployment mechanism 214 is shown in combination with an actuator 291 in a deployed configuration in FIG. 12. In this embodiment, the cam 234 functions as an actuator shaft rotatably mounted to the actuator 291 for selectively rotating the control fin 212 about a longitudinal axis 256 of the cam 234 once the control fin 212 is in the deployed orientation. A missile guidance controller (not shown) selectively controls the actuator 291 to rotate the control fin 212 relative to the direction of airflow for controlled flight of the missile.

More specifically, as shown in FIG. 12, the cam 234 is seated in the actuator 291 within an upper bearing 293 and a lower bearing 295. The cam 234 has threads on an outer surface of the lower end for receiving a threaded nut 297 thereon. The cam 234 also has an upper land or ridge 299. The upper ridge 299 engages the inner race of the upper bearing 293, and the nut 297 engages an inner race of the lower bearing 295. As the nut 297 is tightened and torqued, the two bearings 293 and 295 are trapped across a mounting block 301 of the actuator 291 and pre-loaded to secure the cam 234 to the actuator 291. This keeps the cam 234 from rattling around and allows the actuator 291 to rotate the cam 234, and thus the fin 212, at high speeds.

Figure 15:
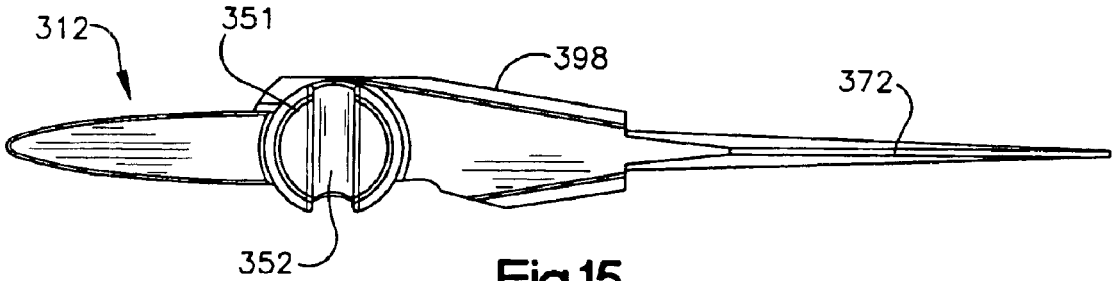
FIG. 15 is a schematic bottom view of the fin shown in FIG. 13.
Figure 10A:
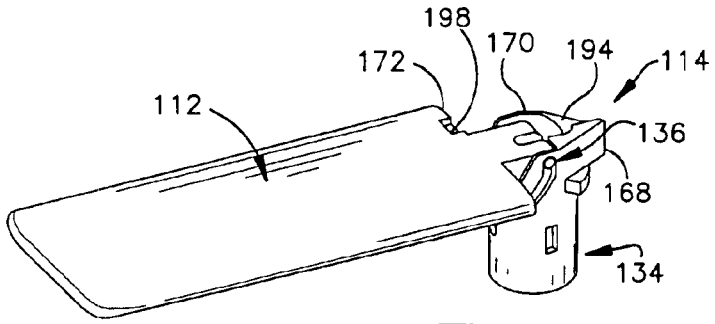
FIGS. 10*a*–10*e* are a sequence of schematic perspective views of the fin and the deployment mechanism shown in FIG. 6 transitioning from the stowed configuration to the deployed configuration in accordance with the invention.
Figure 10B:
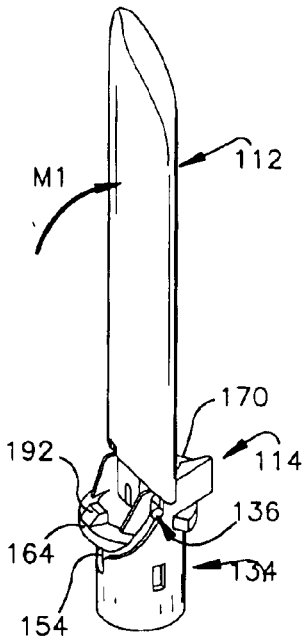
Figure 10C:
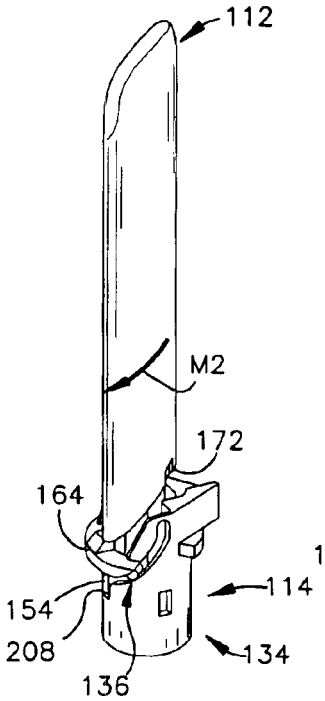
Figure 10D:
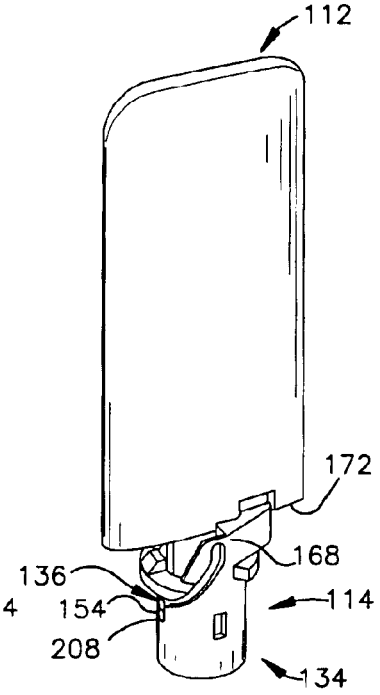
Figure 10E:
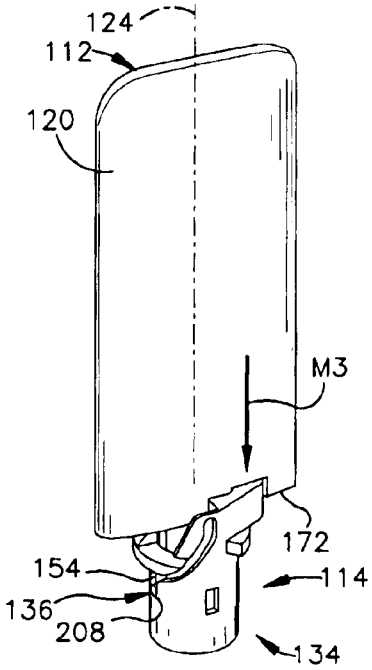
Figure 13:
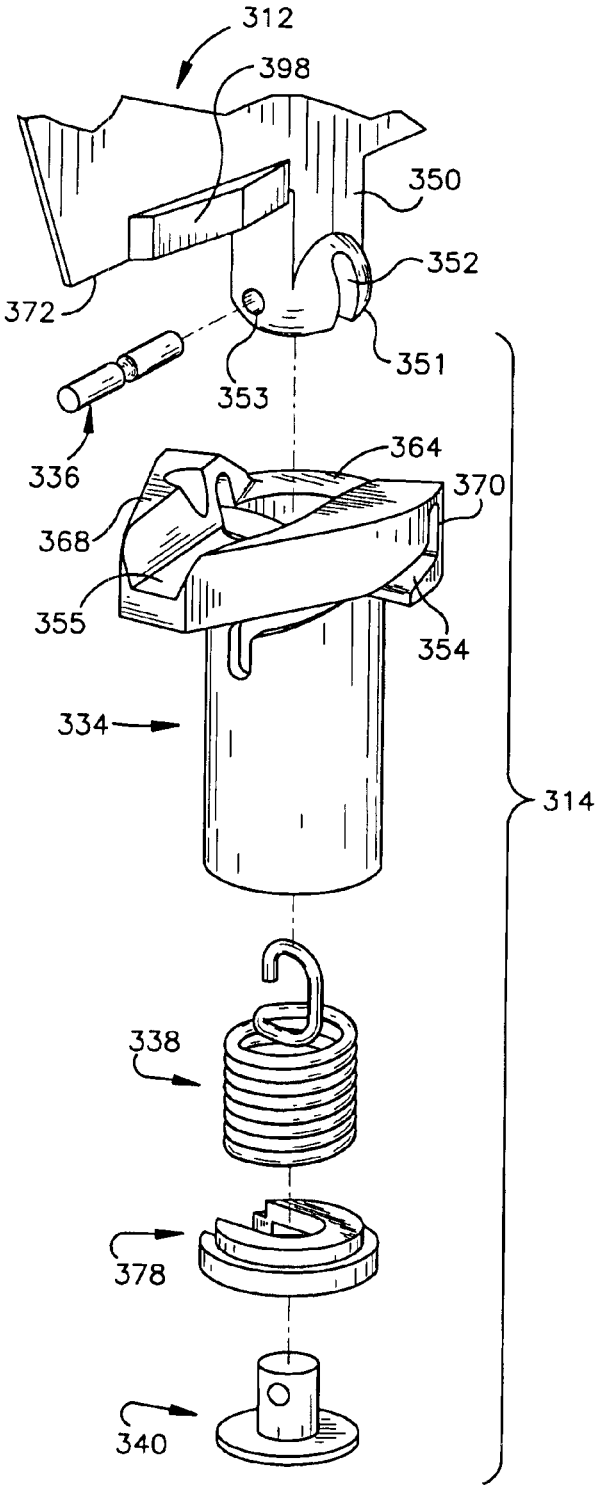
FIG. 13 is an exploded schematic perspective view of the fin and the deployment mechanism in accordance with still another embodiment of the invention.
Figure 14:
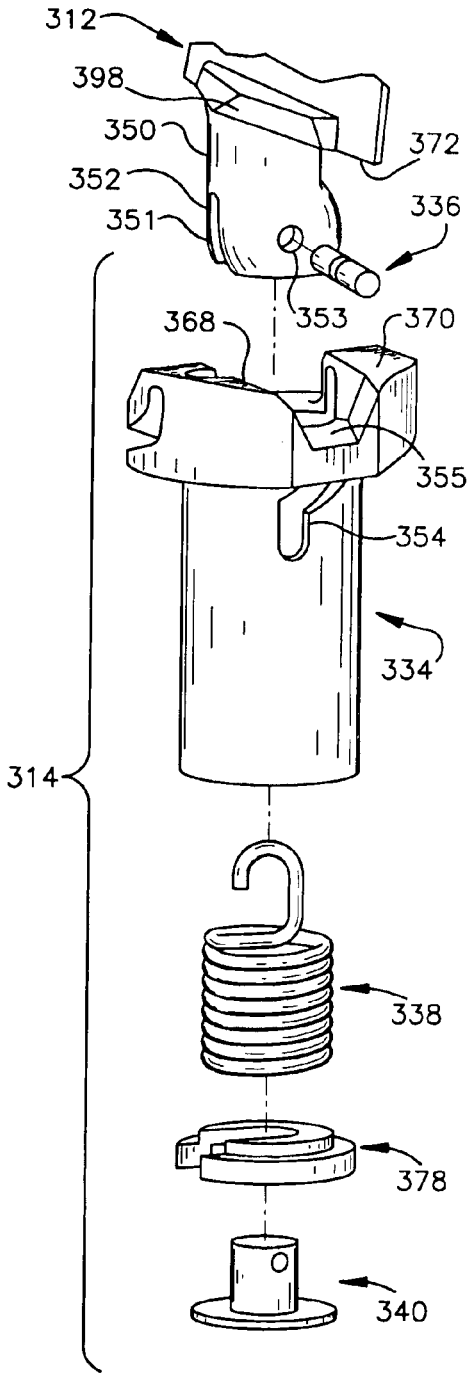
FIG. 14 is an exploded schematic perspective view of the fin and the deployment mechanism shown in FIG. 13 from a different angle.

Now referring to FIGS. 13–15, yet another assembly is shown. This assembly includes a fin 312 and a deployment mechanism 314. The fin 312 has a connecting portion 350 with a spherical attachment point 351. The spherical attachment point 351 has a central notch 352, which separates the spherical attachment point 351 into two generally hemispherical portions. The spherical attachment point 351 also has a through hole 353 for receiving a cam pin 336 therein.

The spherical attachment point 351 is manufactured to fit with a very close tolerance against the inner diameter of the cam 334. This allows the spherical attachment point 351 to reduce the stress on the cam pin 336 as the fin 312 pivots and rotates from the stowed orientation to the deployed orientation. In particular, the spherical attachment point 351 reduces the stresses acting on the cam pin 336 in the fully deployed orientation of the fin 212 by transferring those stresses to the spherical attachment point 351.

At a base 372 of the fin 312, wedge shape protrusions extend from opposite faces of the fin 312 to form a key 398. The key 398 cooperates with the deployment mechanism 314 to help hold the fin 312 in the deployed orientation as will be clear from the following explanation.

The deployment mechanism 314 is substantially similar to the previously described deployment mechanism 114 (FIG. 6) except as particularly described in the following paragraphs. The deployment mechanism 314 includes the cam 334, the cam pin 336, a drive spring 338, a pivot pin 340 and a disk 378 assembled as described with respect to FIGS. 6–10. The cam 334 has a relieved portion 364 and two laterally spaced upright sections 368 and 370. Between the laterally spaced upright sections 368 and 370 and opposite the relieved portion 364 is a keyway 355. The keyway 355 provides additional stability for the fin 312 upon full deployment and prevents or minimizes rocking of the fin 312 during the remainder of the missile's flight.

Figure 16:
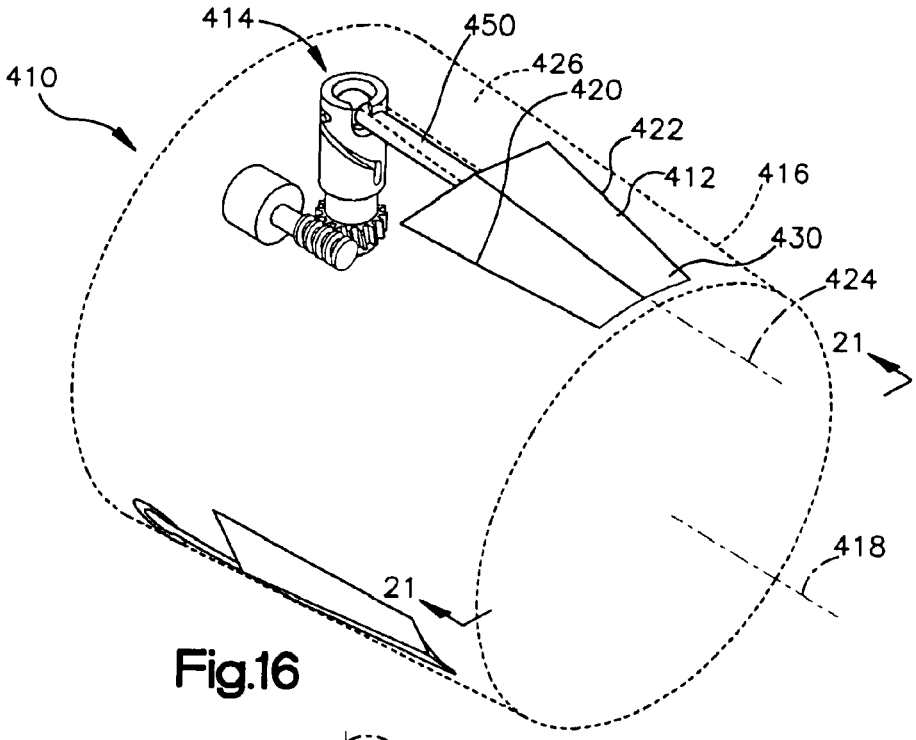
FIG. 16 is a partial and schematic perspective view of a forward section of an exemplary guided projectile housing with aerodynamic fins in a stowed configuration in accordance with still another embodiment of the invention.
Figure 17:
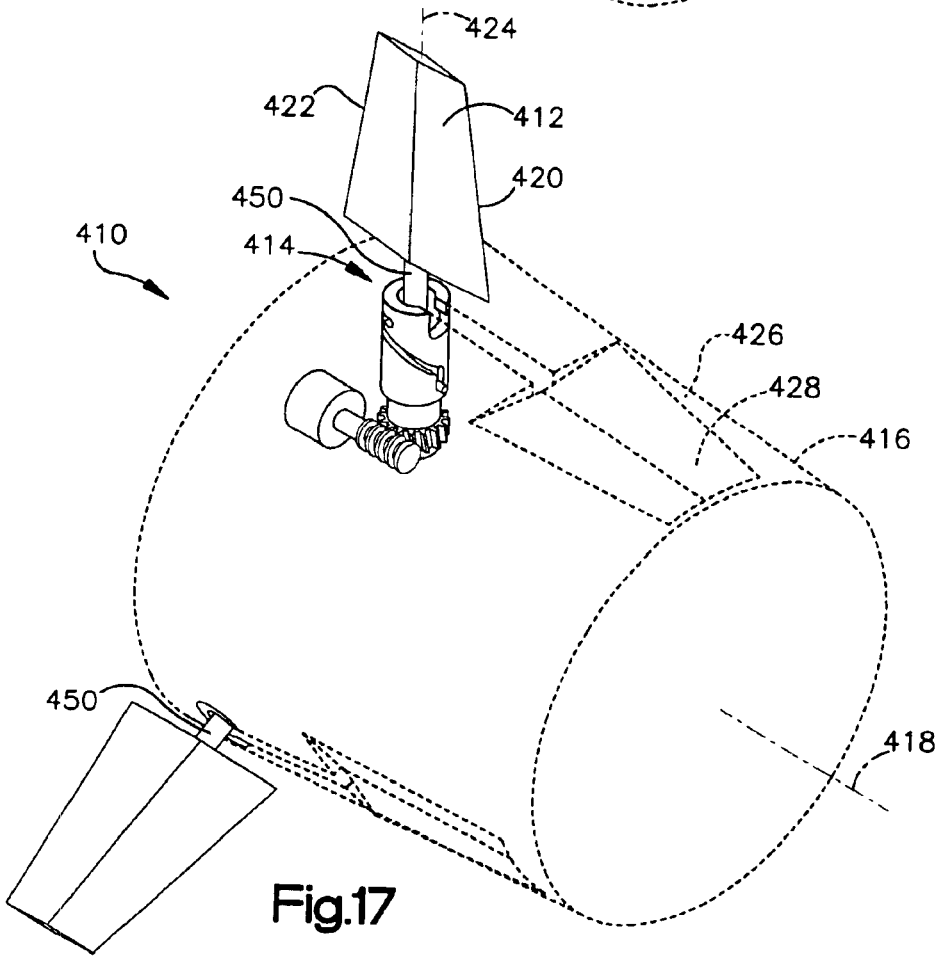
FIG. 17 is a partial and schematic perspective view of the guided projectile housing shown in FIG. 16 with the fins in a deployed configuration.

Now referring to FIGS. 16–17, yet another embodiment of the invention is shown. This embodiment includes at least one stowable fin 412 and a deployment mechanism 414 for moving the fin 412 from a stowed configuration (FIG. 16) to a deployed configuration (FIG. 17) so that a guided projectile 410 (only a relevant portion of guided projectile housing is illustrated in FIGS. 16–17) can be stored or launched in a more compact configuration. The illustrated guided projectile 410 has three fins 412 mounted to a generally ogival housing (guided projectile housing) 416 having a longitudinal axis 418. Although the present description refers to the guided projectile 410 shown in the drawings, the illustrated guided projectile 410 represents any type of ordnance that uses stowable fins and is not limited to a guided projectile. Further, the invention can be tailored to any type of ordnance any number of fins 412.

In the stowed configuration shown in FIG. 16, the fins 412 lie adjacent to a surface 426 of the guided projectile housing 416. The longitudinal axis 424 of each fin 412 approximately parallels the longitudinal axis 418 of the guided projectile housing 416, and the leading edge 420 and the trailing edge 422 of each fin 412 face sideways to provide a compact stowed configuration wherein the guided projectile 410 occupies a minimum volume. In an exemplary embodiment, the longitudinal axis 424 of each fin 412 may be angled toward the longitudinal axis 418 to better conform to the guided projectile housing 416. In the illustrated embodiment, the guided projectile housing 416 has a longitudinally extending recess 428 with (FIG. 17) in its surface 426 for receiving the fin 412 (including a connecting portion 450 further described below) in the stowed or stored configuration. With the fin 412 stowed and received in the recess 428, an outer surface 430 (FIG. 16) of the fin 412 generally conforms to the outer surface 426 of the guided projectile 410. The recess 428 has a shape and size sufficient to receive the fin 412 and the connecting portion 450 while minimizing the internal volume of the guided projectile 410 taken up by the recess 428. In the illustrated embodiment, the recess 428 extends from near an end of the connecting portion 450 of the fin 412 that is attached to the guided projectile 410 toward the forward end of the guided projectile 410.

In the deployed configuration shown in FIG. 17, each fin 412 extends above the surface of the guided projectile housing 416. The longitudinal axis 424 of the fin 412 is approximately perpendicular to the longitudinal axis 418 of the guided projectile housing 416, and the leading edge 420 generally faces toward the forward end of the guided projectile 410. The fin 412 is connected to the guided projectile housing 416 through the deployment mechanism 414, which moves the fin 412 from the stowed orientation to the deployed orientation.

Figure 18:
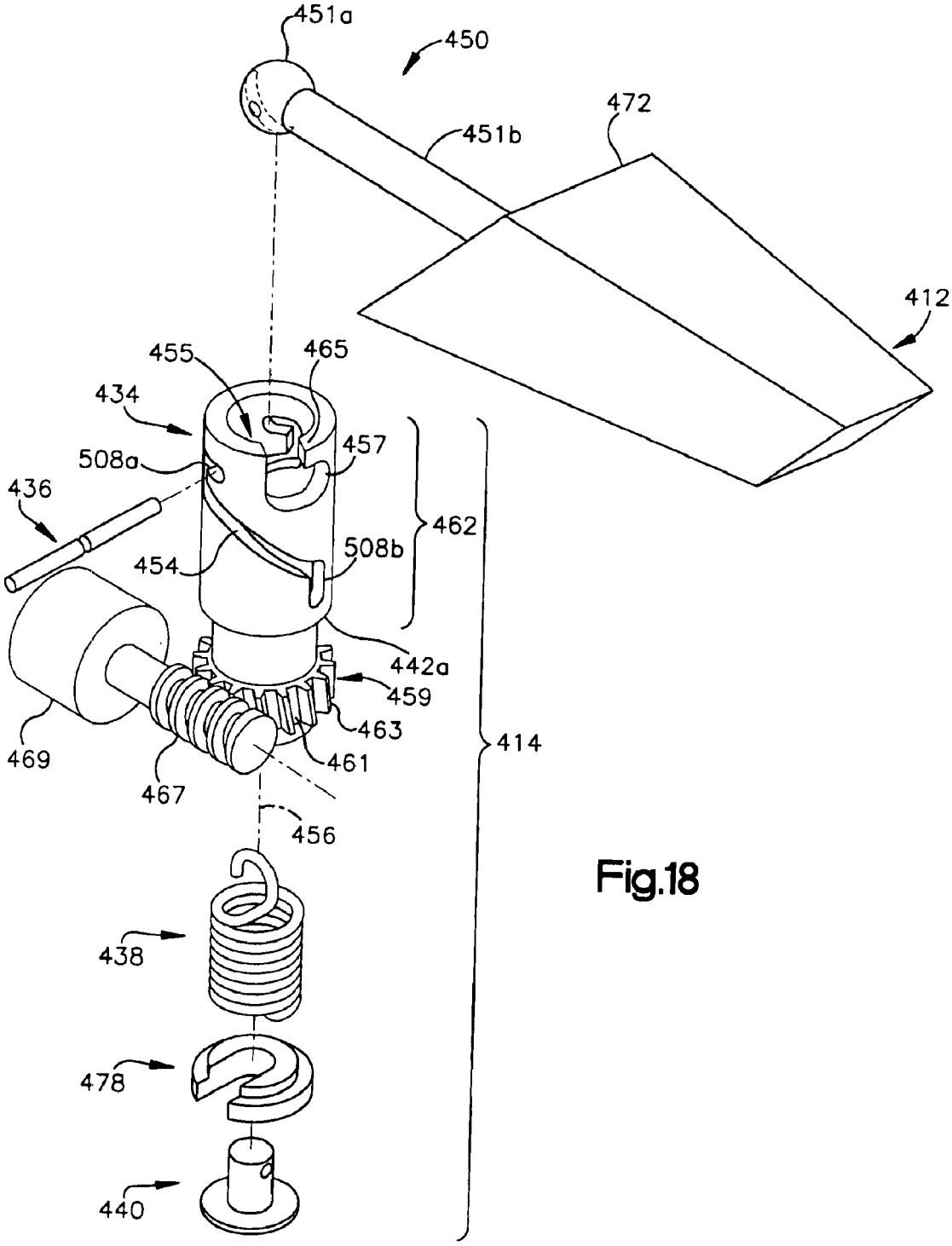
FIG. 18 is an exploded schematic perspective view of the fin and the deployment mechanism shown in FIG. 16.
Figure 19:
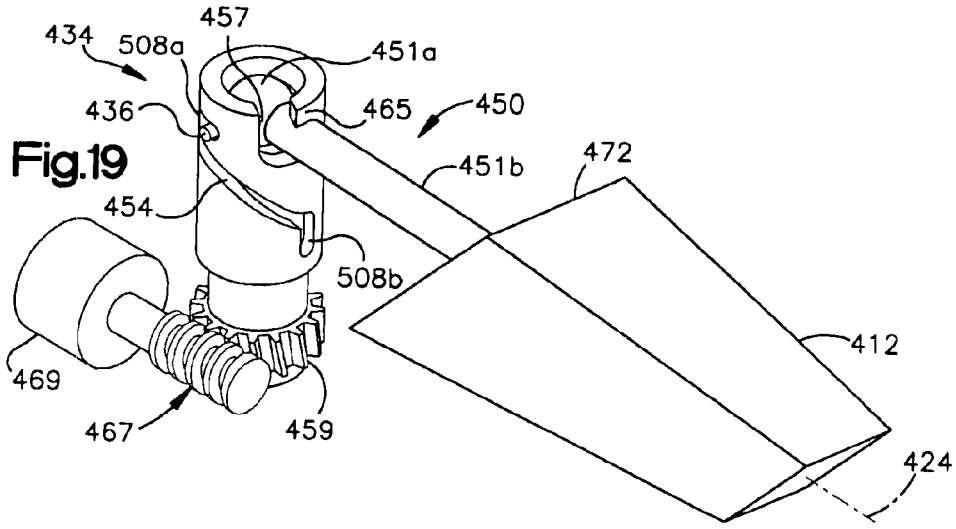
FIG. 19 is a schematic perspective view of the deployment mechanism shown in FIG. 16 with an aerodynamic fin in a stowed configuration.
Figure 20:
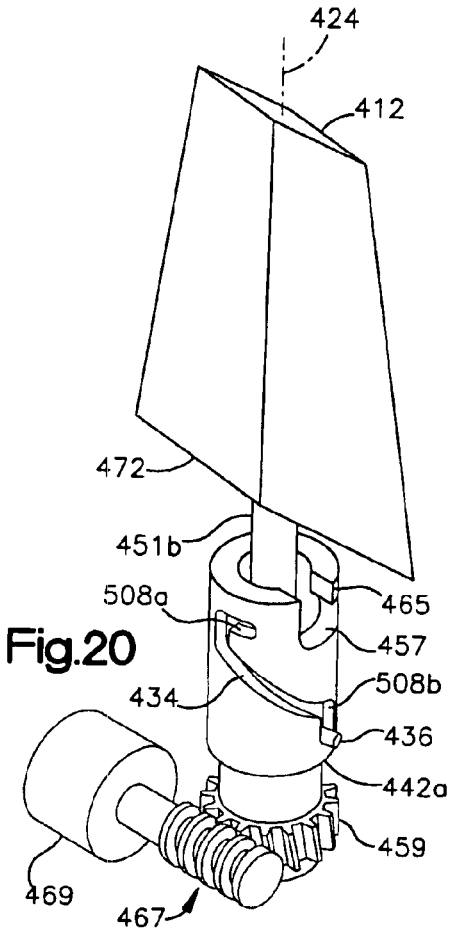
FIG. 20 is a schematic perspective view of the deployment mechanism shown in FIG. 16 with an aerodynamic fin in a deployed configuration.

With reference to FIGS. 18–20, the fin 412 includes the connecting portion 450. The connecting portion 450 includes a spherical attachment point 451*a*, substantially similar to the spherical attachment point 351 illustrated in FIGS. 13–14, and a cylindrical shaft 451*b*. The base 472 of the fin 412 does not include the key 398 illustrated in FIG. 15.

The deployment mechanism 414 is substantially the same as the previously described deployment mechanism 314 (FIGS. 13–14). The 30 deployment mechanism 414 includes a cam 434, a cam pin 436, a drive spring 438, a pivot pin 440 and a disk 478 assembled as described with respect to FIGS. 13–14. However, the deployment mechanism 414 includes a modified cam 434 further described below.

In this embodiment, a working end 462 replaces the relieved portion 364, the two laterally spaced upright sections 368 and 370 and the keyway 355 between the laterally spaced upright sections 368 and 370 opposite the relieved portion 364 of the cam 334 (FIGS. 13–14). The working end 462 includes a retention feature 455 for retaining the fin 412 in the stowed configuration. That is, the working end 462 includes an opening or a retention slot 457 sized for receiving and retaining the cylindrical shaft 451*b* therein as further explained below. Looking at a side view of the cam 434 (FIG. 18), the retention slot 457 appears to form the shape of the letter "L". The L-shape is a "void" area or substantially open space, i.e., an L-shaped retention slot. Looking at a top view of the cam 434 with the retention slot 457 to the right side, the working end 462 appears to form the shape of the letter "C". The opening in the C-shape is a "void" area or substantially open space, i.e., an opening into the L-shaped retention slot 457. A wall or stop 465 is formed above the void of the horizontal component of the "L".

The cam 434 is mounted to the projectile such that an upper surface of the working end 462 is even or proud of the surface of the projectile housing. Further, a surface of the horizontal component of the retention slot 457 is even or proud of the surface of the recess adjacent the cavity, e.g., similar to the recess 28 and relieved portion 64 shown in FIG. 3.

In an exemplary embodiment, the working end 462 of the cam 434 includes an external step or ledge 442*a* formed by an abrupt change in the external diameter of the cam 434. That is, the external diameter of the cam 434 increases at this point.

A worm gear 459 is located about the circumference of the base of the cam 434 below the ledge 442*a*. The worm gear 459 includes an annular ring 461 or disk with gear teeth 463 formed therein to engage a threaded shaft 467 of a worm drive 469 as further described below. The annular ring 461 has a diameter greater than the diameter of the cam 434. In an embodiment, the worm gear teeth 463 are machined into an external sidewall of the cam 434. The gear teeth 463 may be machined to completely circumscribe the cam 434 or may only partially circumscribe the cam 434. For example, the gear teeth 463 may be formed in the cam 434 to provide a specified range of deflection, e.g., plus or minus ten degrees of rotation. The annual ring 461 may be fixedly mounted to the cam 434 by a weld, for example. In an embodiment, the annual ring 461 may be integrally formed in the cam 434.

Referring now to FIGS. 19–20, the cam pin 436 is guided by at least one cam slot or groove 454 formed in the sidewall of the cam 434 and tailored to vary the path and orientation of the fin 412 as the cam pin 436 moves between the stored and deployed configurations. The end portions 508*a* and 508*b* of the cam slots 454 may provide positive stops for the cam pin 436 corresponding to the stored and deployed orientations of the fin 412. In other words, the cam pin 436 may engage the ends 508*a* and 508*b* of the cam slots 454 at the stored and deployed orientations of the fin 412, respectively.

The upper end 508*a* has a horizontal component in a direction away from the retention slot 457. For stowing the fin 412 in the recess 428 of the housing 416, the upper end 508*a* allows the cam pin 436 to engage a portion of the cylindrical shaft 451*a* of the fin 412 in the retention slot 457 by allowing the cam 434 to "over rotate" or overtravel. That is, the cylindrical shaft 451*a* is partially retained by the stop 465 of the horizontal component of the retention slot 457 as the cam 434 is rotated past the point which allows the shaft 451*a* to traverse the opening of the retention slot 457. Accordingly, the cam pin 436 must travel in cam slot 454 in a direction perpendicular to the longitudinal axis 418, i.e. in a direction opposite the direction of the rotation of the cam 434.

During the deployment motion, the cam 434 is rotated by the worm drive 469 until the cylindrical shaft 451*b* is free to pivot through the vertical component of the retention slot 457. Simultaneously, the cam pin 436 is rotated out of the end 508*a*. The shaft 451*b* is prevented from rotating in the horizontal plane by the walls of the recess 428 adjacent the shaft 451*b*. Next, the laterally extending 30 end portions of the cam pin 436 spiral through the cam slots 454 similar to the motion described above in relation to FIGS. 10*a*–10*e*.

The retention slot 457 retains the fin 412 inside the recessed area during the firing of the guided projectile, i.e., during the launch of the projectile through the bore of the weapon system. The ends 508*b* prevent or minimize rocking of the fin 412 during the remainder of the guided projectile's flight.

Figure 21:
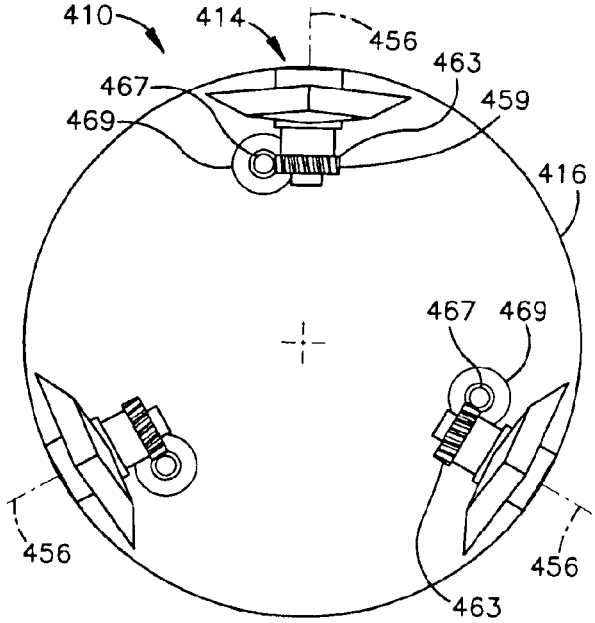
FIG. 21 is a partial and schematic cross-sectional view of the guided projectile housing illustrated in FIG. 16 showing an operational configuration of three deployment mechanisms with actuator systems operationally coupled thereto.

The deployment mechanism 414 is shown in combination with an actuator 469 or worm drive in a deployed configuration in FIG. 21. In this embodiment, the cam 434 functions as an actuator shaft rotatably mounted to the actuator 469 for selectively rotating the control fin 412 about a longitudinal axis 456 of the cam 434 once the control fin 412 is in the deployed orientation. A projectile guidance controller (not shown) selectively controls the actuator 469 to rotate the control fin 412 relative to the direction of airflow for controlled flight of the projectile 410.

More specifically, as shown in FIG. 21, the cam 434 is seated in the guided projectile housing 416. The threaded shaft 467 of the worm drive 469 is mounted to the projectile's housing such that the threaded shaft 467 can engage the gear teeth 463 on an outer surface of the cam 234. Rotating the threaded shaft 467 clockwise or counterclockwise allows the actuator 469 to rotate the cam 434, and thus the fin 412, at high speeds.

The invention thus provides a simple and reliable mechanism to both hold the fins in a stowed position and to release the fins to a deployed configuration. Further, no parts of the device are shed or broken away upon deployment of the fins, thereby minimizing or eliminating the risk of injury to the launch vehicle or operator.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components (assemblies, devices, sensors, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A deployment mechanism having at least one aerodynamic fin, comprising:

a tubular cam including a retention mechanism, the tubular cam mountable in a projectile for deploying the at least one fin from a stowed orientation to a deployed orientation that is different from the stowed orientation, and the retention mechanism operationally configured to maintain the at least one fin in the stowed orientation when not deployed.

2. A deployment mechanism as set forth in claim 1, wherein the retention mechanism includes a retention slot.

3. A deployment mechanism as set forth in claim 2, wherein the retention slot is "L" shaped.

4. A deployment mechanism as set forth in claim 2, wherein the retention slot includes a stop, the stop partially retains a connecting portion of the at least one aerodynamic fin.

5. A deployment mechanism as set forth in claim 1, wherein the tubular cam includes a worm gear formed in a sidewall of the tubular cam and the worm gear is used to rotate the tubular cam.

6. A deployment mechanism as set forth in claim 5, wherein the worm gear completely circumscribes the tubular cam.

7. A deployment mechanism as set forth in claim 5, wherein the worm gear partially circumscribes the tubular cam.

8. A deployment mechanism as set forth in claim 1, wherein the tubular cam includes at least one cam slot; and a cam pin connected to the at least one fin and extending into the at least one cam slot; a spring is connected to the cam pinto urge the cam pin to a deployed configuration in which the at least one fin is in the deployed orientation, and the cam pin is movable along and guided by the at least one cam slot to pivot the at least one fin and to rotate the at least one fin from the stowed orientation to the deployed orientation.

9. A deployment mechanism as set forth in claim 8, wherein the cam pin is rotatable relative to a drive pin that interconnects the cam pin and the spring.

10. A deployment mechanism as set forth in claim 9, wherein the drive pin includes a portion having an abrupt increase in diameter against which the spring acts.

11. A deployment mechanism as set forth in claim 8, wherein the cam pin is rotatable relative to the spring that interconnects the cam pin and a pivot pin.

12. A deployment mechanism as set forth in claim 8, wherein the tubular cam has an upper face that forms a fulcrum about which the at least one fin pivots.

13. A deployment mechanism as set forth in claim 8, wherein the at least one cam slot includes an end with a horizontal component for receiving the cam pin when the tubular cam is over rotated to engage the retention mechanism.

14. A guided projectile comprising:

at least one aerodynamic fin; and a deployment mechanism including a tubular earn including a retention mechanism, the deployment mechanism for deploying the at least one fin from a stowed orientation to a deployed orientation that in different from the stowed orientation, and the retention mechanism operationally configured to maintain the at least one fin in the stowed orientation when not deployed.

15. A guided projectile as set forth in claim 14, wherein the deployment mechanism pivots and rotates the at least one fin into the deployed orientation.

16. A guided projectile as set forth in claim 14, wherein the tubular cam includes at least one cam slot; and a cam pin connected to the at least one fin and extending into the at least one cam slot; a spring is connected to the cam pin to urge the cam pin to a deployed configuration that includes the at least one fin in the deployed orientation, and the cam pin is guided by the at least one cam slot to simultaneously pivot the at least one fin and rotate the at least one fin into the deployed orientation.

17. A guided projectile as set forth in claim 14, wherein the guided projectile has a generally cylindrical surface and a recess in the surface sized to receive the at least one fin in the stowed orientation.

18. A guided projectile as set forth in claim 14, wherein the retention mechanism includes a retention slot.

19. A guided projectile as set forth in claim 16, wherein the guided projectile has an actuator to receive the deployment mechanism therein and to rotate the at least one fin in the deployed orientation by rotating the tubular cam.

20. A guided projectile as set forth in claim 19, wherein the actuator includes a worm drive.

* * * * *